US005524770A

United States Patent [19]

LeBlanc et al.

[11] Patent Number: 5,524,770

[45] Date of Patent: Jun. 11, 1996

[54] BASKET PROFILE FOR SCREENS

[75] Inventors: Peter LeBlanc, Worthington, Mass.; David E. Ray, S. Portland, Me.

[73] Assignee: Beloit Technologies, Inc., Wilmington, Del.

[21] Appl. No.: 553,133

[22] Filed: Nov. 7, 1995

Related U.S. Application Data

[63] Continuation of Ser. No. 737,938, Jul. 29, 1991, abandoned, which is a continuation of Ser. No. 425,897, Oct. 23, 1989, abandoned.

[51] Int. Cl.[6] ..... B07B 1/04

[52] U.S. Cl. ..... 209/273; 209/397; 209/306

[58] Field of Search ..... 209/273, 270, 209/397, 306, 380; 210/413, 415; 162/55

[56] References Cited

U.S. PATENT DOCUMENTS

| | | | |
|---|---|---|---|
| 3,409,132 | 11/1968 | Meadows | 209/393 X |
| 4,200,537 | 4/1980 | Lamort . | |
| 4,529,520 | 7/1985 | Lampenius | 209/397 X |
| 4,776,957 | 10/1988 | Lampenius et al. | 209/273 X |
| 4,812,229 | 3/1989 | Tra | 209/273 X |
| 4,836,915 | 6/1989 | Frejborg | 209/397 X |
| 4,855,038 | 8/1989 | LeBlanc . | |
| 4,880,540 | 11/1989 | Frejborg | 209/273 X |
| 4,950,402 | 8/1990 | Frejborg | 209/273 X |
| 4,986,900 | 1/1991 | Mason | 209/397 |
| 5,000,842 | 3/1991 | Ljokkoi | 209/273 |
| 5,073,254 | 12/1991 | Beisenherz et al. | 209/273 |

FOREIGN PATENT DOCUMENTS

| | | | |
|---|---|---|---|
| 206975 | 12/1986 | European Pat. Off. | 162/55 |
| 2849769 | 6/1979 | Germany . | |
| 8809843 | 12/1988 | WIPO . | |
| 8810335 | 12/1988 | WIPO . | |

*Primary Examiner*—D. Glenn Dayoan

*Attorney, Agent, or Firm*—Dirk J. Veneman; Raymond W. Campbell

[57] ABSTRACT

A replaceable screen structure for a stock screen where stock slurry for making paper is passed through a screen with the rejects going to a reject outlet and the accepts passing through openings in the screen to an accepts outlet, with the screen having projections and a rotor inducing a pulsating induced flow along the profile surface, with projections on the surface having an inclined ramp of less than about 45° and a 90° downstream wall and accepts flow openings between the projections positioned closer to the upstream projection than the downstream projection.

15 Claims, 2 Drawing Sheets

BASKET PROFILE FOR SCREENS

This is a continuation of application Ser. No. 07/737,938 filed on Jul. 29, 1991 now abandoned, which is a continuation of 07/425,897 filed Oct. 23, 1989, now abandoned.

BACKGROUND OF THE INVENTION

The invention relates to improved paper machine stock screens, and more particularly to an improvement in a profiled screen construction which improves the efficiency and effectiveness of the screening operation.

Stock screens are used in the paper making process for aiding in cleaning the stock before it flows to the headbox to be dewatered to form a web. Such stock screens are conventionally tubular in shape, with the stock being admitted near one end of the screen and directed either to the inner surface or the outer surface of the tubular screen. The accepted stock flows through the screen, and the rejected stock including shives, particles, dirt and the like not passing through the screen flows to the other end of the screen to be removed through a reject line. Typically, the accepts are received by an annular chamber, with the annular chamber surrounding the screen in the case where the supply stock is delivered to the inside of the screen and the stock flows outwardly through the screen in the screening operation. In commercial operation, it is desirable that the screen operate under pressure. Stock is pumped into one end of the tubular screen to enter the interior of the screen tangentially, and the pressurized screen will operate under a wide range of stock velocity. For aiding in the rapid flow of acceptable stock through the screen and preventing the fibers from building up on the screen surface, shaped foils are continuously moved around along the surface of the screen.

U.S. Pat. No. 4,855,038 discloses an improved arrangement for generating a turbulence along the screen basket surface providing strong negative and positive pulses and inducing a pulsating flow along the inner surface of the screen.

With the generation of the pulsations, accepted fibers flow through openings in the screen and are captured to flow to a headbox or to a vat. The rejected fibers and impurities, which do not pass through openings in the screen, pass out through a reject outlet.

In working with paper machine pulp screening apparatus, it has been noted that at times variations in throughput of 4 to 5 times magnitude were experienced. The screen baskets are changeable, and changing baskets which were of similar construction resulted in a wide yield variation. Upon further study, it was determined that the characteristic of the inner screening surface of the cylindrical screen had a pronounced effect on the throughput of the screen as well as its durability in reduced breakage and the elimination of the necessity of frequent cleaning.

It is accordingly an object of the present invention to provide an improved screen structure for screening paper machine pulp which can be constructed in accordance with certain parameters, and which yields a surprising increase in throughput of acceptable stock.

A further object of the present invention is to provide an improved screen structure which resists wear and eliminates the need for frequent screen replacement.

A still further object of the present invention is to provide an improved paper machine pulp screen capable of operation without frequent cleaning, avoiding the accumulation of residual material in the openings.

Yet another object of the present invention is to provide an optimum screen profile, which in operation yields consistent performance in throughput, efficiency, and durability.

FEATURES OF THE INVENTION

In working with screens utilizing pulsations generated along the screen surface and the generation of significant turbulence along the inner screen surface, it has been discovered that certain small structural changes greatly improve the performance of the screen. With the provisions of projections along the inner screen surface and openings between the projections, and with unique shaping of the projections and location of the openings, improvements in throughput of 4 to 5 times magnitude can be accomplished. Further, the failure rate for the screen baskets can be reduced from 80% to 5%. Also, the accumulation of residual material in the openings has been reduced so that frequent cleaning is obviated.

In accordance with the structural requirements, the cylindrical screens have projections which have an inclined ramp in the direction of induced flow along the surface, with the ramps having an angle of less than 45° with the general surface of the screen. The downstream side of the ramps end in a vertical wall of substantially 90°. The projections are arranged to occur no more than 8 per inch, and the openings between projections are arranged in the first half of the space between the projections, that is, closer to the upstream projection than the downstream in the direction of induced flow. The depth of the openings is at least 0.20", and the projections have a minimum height of 0.032". The openings are located so that a line drawn from the center of the opening to the trailing tip of the projection forms an angle of at least 45° with the screen surface. This construction has been compared with various constructions not adhering to these requirements and it has been experienced that substantial increased flow of accepts through the openings results.

Other objects, advantages, and features will become more apparent with the teaching of the principles of the invention in connection with the disclosure of the preferred embodiments thereof, in the specification, claims and drawings, in which:

DESCRIPTION OF THE PREFERRED EMBODIMENTS

Figure 1:
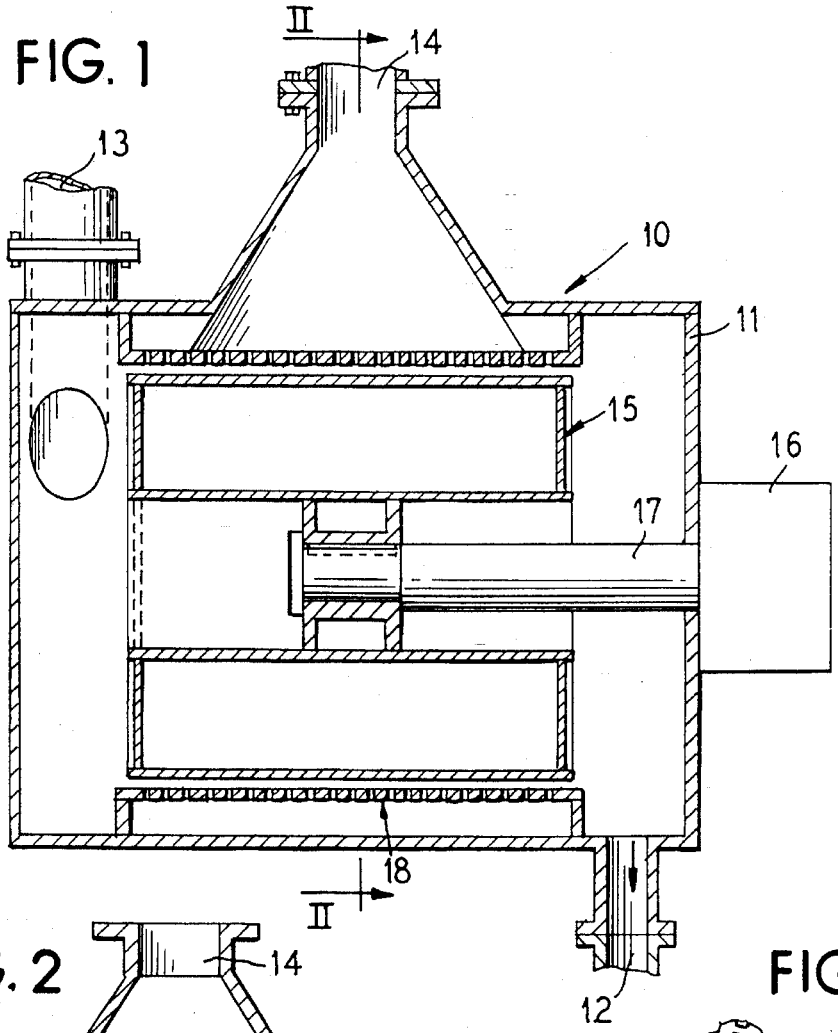
FIG. 1 is a vertical sectional view taken substantially through the axis of a screening mechanism constructed and operating in accordance with the principles of the present invention.
Figure 2:
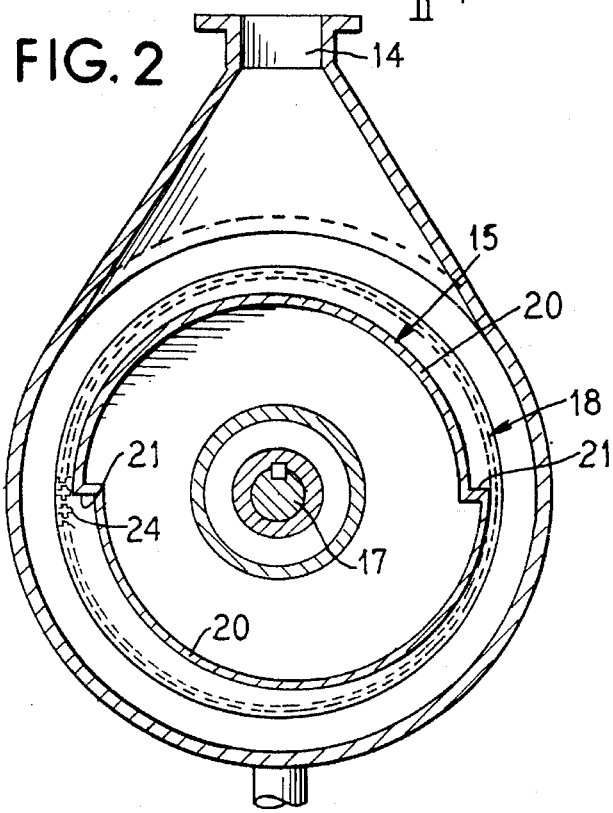
FIG. 2 is a vertical sectional view taken substantially along line II—II of FIG. 1.

As illustrated in FIGS. 1 and 2, a screening apparatus is shown generally at 10 including an outer housing 11 forming a chamber therein for containing stock or performing the screening operation. A slurry of paper stock is pumped under pressure through an inlet conduit 13 leading into the housing. As the stock is screened, the accepts flow out through an accept outlet 14 from the housing and the rejects flow through rejects outlet 12 exiting from the housing.

Mounted within the housing, which is somewhat cylindrical in shape, is a profile screen 18 which is tubular or cylindrical in shape.

Mounting concentrically within the tubular profile screen is a rotor 15 which is supported on a drive shaft 17 driven by a suitable drive mechanism 16 supported on an end wall of the housing 11. The rotor shown is a preferred structure for use with the basket shown and described; however, other rotors, including bumped rotors and foils, can be used with the present invention.

Figure 3:
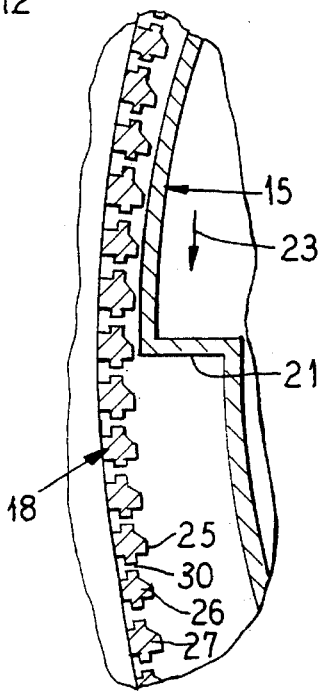
FIG. 3 is an enlarged fragmentary sectional view illustrating the structure of the projections on the inner surface of the screen relative to the rotor.

As illustrated in FIGS. 2 and 3, the rotor 15 has a cam-like shape including a pair of blunt leading edges 21 followed by arcuate sections 20. The arcuate sections 20 each have the same radius of curvature. Only two of the semi-cylindrical structures 20 are shown with blunt edges 21, but it is to be understood that more sections could be employed. The blunt edges 21 are so shaped to be capable of capturing a certain volume of stock and accelerating it up to rotor velocity. The leading edges 21 could be forwardly inclined with respect to the direction of rotation or could be concave in shape, and the structural features of the rotor are also described in the aforementioned U.S. Pat. No. 4,855,038.

A significant feature of the invention resides in the arrangement of structures forming profiles 24 on the inner surface of the screen and openings 30 through which the accepted fibers of the slurry pass. As shown in greater detail in FIG. 4, individual projections such as 25, 26, and 27 project radially inwardly to form the profile surface of the screen. It has been found that the individual projections should be spaced such that a maximum of eight per inch of screen circumference and preferably about six or seven per inch are provided.

The projections may be individualized but preferably extend along the axial length of the cylindrical screen. as the rotor 15 turns, it induces a flow of stock along the surface of the screen generating a screening pulse and generating, with the coaction of the projections, a turbulence. With the structure of the projections and the particular location of openings 30 between the projections, this turbulence is exploited to its maximum to result in a discovered substantial increase in flow through the openings and an increase in screening results. The increased total flow is very important in that it reduces the number of screening mechanisms necessary for a papermaker or increases the output of each screen mechanism used.

Figure 4:
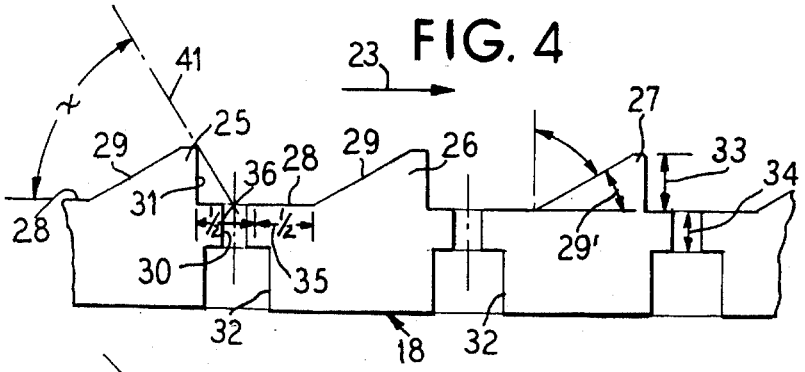
FIG. 4 is a greatly enlarged section taken through the projections illustrating a preferred structure.

The projections such as 25, 26, and 27 extend outwardly from a floor 28 and have a lead-in ramp 29 which faces upstream and faces the oncoming flow of stock moving in the induced flow direction as indicated by the arrowed line 23 in FIGS. 3 and 4. The ramp is at an angle with the floor 28, the angle being shown at 29' in FIG. 4. This ramp angle was discovered to be effective when having an angle less than 45° and preferably an angle of 30° to 35° is used.

On the downstream side of the projections, is a vertical wall 31 which is at 90° with the floor 28 and faces generally downstream. It has been found that the formation of this angle is important, and a substantial right angle should be formed, with minimal residual material remaining after machining.

Between the projection such as 25, 26, and 27, are flow openings 30. These openings are critically positioned in a channel 32 on the accept side of the screen so as to be located closer to the upstream projection 25 than the downstream projection 26. That is, in the floor area shown at 28 in FIG. 4 between the projections 25 and 26, if this floor area is divided into halves as indicated by the dimension lines in FIG. 4, the space 35 from the opening 30 to the beginning of the ramp 29 for the projection 26 is greater than the space 36 from the vertical wall 31 to the opening. By locating the openings closer to the upstream projection than the downstream projection, it is believed that the effect of turbulence caused by the projections and by the rotor is maximized, to effectively increase the flow of accepts through the opening and to keep the opening clean so that it does not build up with fibers and require purging.

In addition to locating the opening relative to its position between the projections, it has been found that there is a relationship between the location of the openings 30 and the height and location of the upstream projection. With reference to the opening 30 between projections 25 and 26, this location is such that a line 41 which is drawn from the center of the opening to intersect the trailing high point of the projection 25, forms an angle X with the floor 28. This angle X is at least about 45°, and the preferred angle X is in the range of 50° to 60° for maximum performance.

A further significant factor in the construction of the screen is the height of the projections shown by the dimension line 33. The projections should extend above the surface of floor 28 at least about 0.032" and preferably over 0.040".

A further factor in the optimum screening operation relates to the openings 30, and specifically the depth of the openings 30, as indicated by the dimension line 34. These openings should have a depth of at least 0.020" but not more than 0.040". This depth not only improves the operating characteristic of the screen, but also substantially improves its operating life, avoiding cracking and defects which require changing of the screen.

Figure 5:
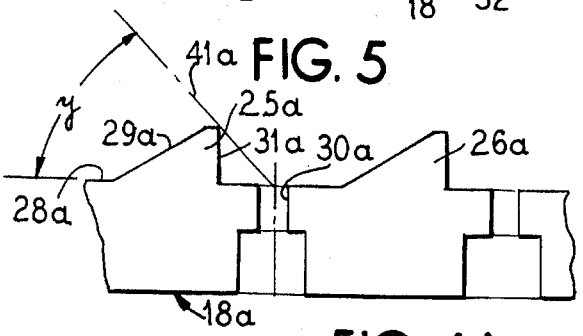
FIGS. 5 and 6 are enlarged fragmentary sectional illustrations showing other screen profiles which deviate from the principles of the present invention and do not achieve the advantages of the invention.
Figure 6:
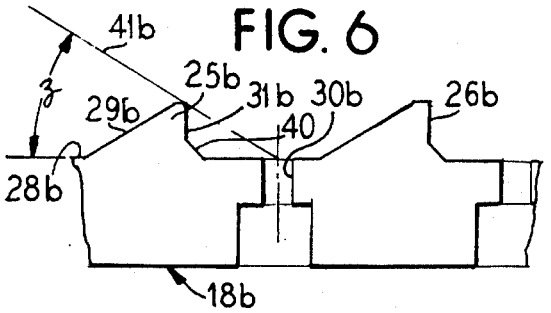

In FIG. 5, the elements of the screen are numbered similarly to FIG. 4, except each number has a letter "a" as a suffix. In FIG. 6, the parts are also similarly numbered except each number has the suffix "b".

FIG. 5 illustrates a screen arranged with projections on the surface and openings therebetween which are outside of the range of effective operating of the scope of the invention. In FIG. 5, the angle Y is less than 45°. The diagonal **41*a* drawn from the center of the opening 30*a* through the trailing tip of the projection 25*a* forms an angle with the floor 28*a* of the screen which is less than 45°. The opening 30*a* is substantially centrally located between the projections 25*a* and 26*a***.

FIG. 6 illustrates another structure wherein the optimum requirements of the features of the invention are not met. An angle Z is formed between a diagonal line **41*b* from the center of the opening 30*b*, which is located even further from projection 25*b*, and the trailing end of the projection 25*b* to form an angle Z less than 45°. In this case, the opening 30*b* is positioned closer to the projection 26*b* than the opening 25*b* so that the angle Z is less than the preferred angle of 45°. Another deviation of the structure of FIG. 6 is the provision of a fillet between the trailing edge 31*b* of the projection and the floor 28*b* between the projections 25*b* and 26*b***.

Figure 4A:
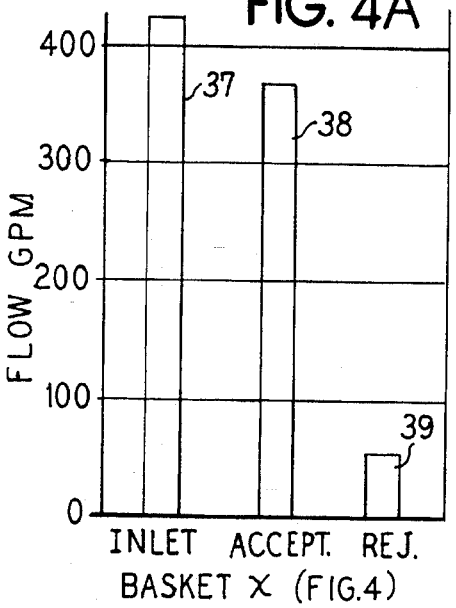
FIG. 4A is a graph illustrating relative accepted performance factors of the structure of FIG. 4.

FIGS. 4A through 6A illustrate expected performance characteristics of the structures of FIGS. 4, 5, and 6, respectively. In FIG. 4A, the throughput graph line is indicated by the bar 37. The amount of accepts passing the screen is indicated by the bar 38 and the amount of rejects is indicated by the bar 39.

Figure 5A:
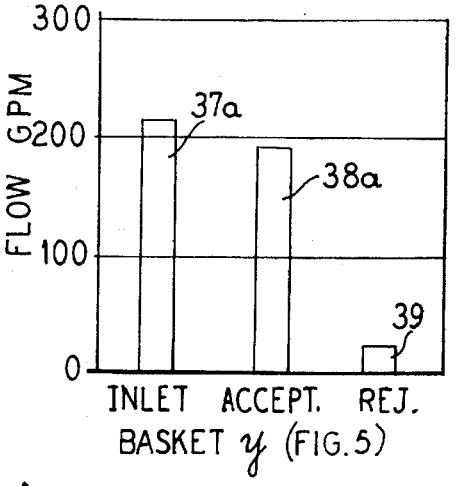
FIGS. 5A and 6A, respectively, illustrate the reduced performance characteristics experienced with the structures illustrated in FIGS. 5 and 6, respectively.

As will be seen in FIG. 5A, operating under similar circumstances, the amount of throughput of stock flow is substantially reduced to almost one-half as indicated by the bar 37*a*. The bar 38*a* indicates the accepts, and 39*a* the rejects.

Figure 6A:
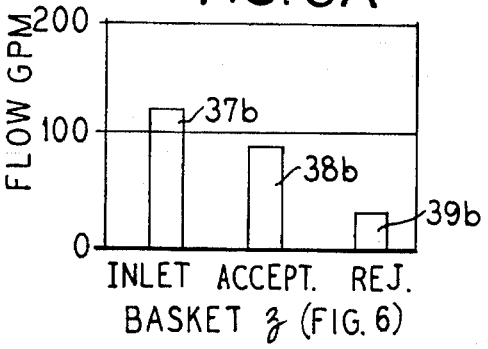

In FIG. 6A, the performance of the screen is still further reduced with the structure shown in FIG. 6. The bar 37*b* indicates the throughput of stock and bar 38*b* indicates the throughput of accepts, and bar 39*b* the throughput of rejects.

Thus, it will be seen that we have provided an improved screening structure which is capable of substantial advantages over devices heretofore obtainable. As set forth above, by the critical positioning and spacing of the projections, positioning of the openings, the angle of the inclined ramp and the depth of the openings, the operating factors of screening and turbulence are maximized so as to substantially increase the usefulness and efficiency of the screening mechanism.

We claim as our invention:

1. In a mechanism for screening a stock slurry for making paper, comprising in combination:

a screening housing having an inlet for fibrous stock slurry, an accepts outlet for screened slurry and a rejects outlet;

a screen in the housing positioned for receiving the slurry on a profile surface and having accept flow openings extending through the screen for passing accepts from one side of the screen to another side of the screen to the accepts outlet and for obtaining rejects which do not pass through the openings to flow to the rejects outlet;

and means generating a screening pulse in the slurry along the profile surface in an induced flow direction;

said profile surface having projections with a recessed floor between projections, the improvement comprising;

the accept flow openings being disposed in the recessed floor between projections, the openings being substantially uniformally located between projections and being located more closely to the upstream projection than to the downstream projection relative to said induced flow direction so that a maximum screening occurs with significant turbulence along the profile surface;

wherein the projections have an upstream facing ramp forming an angle of less than 45° with the floor of the profile surface.

2. A mechanism for screening a stock slurry for making paper constructed in accordance with claim 1 wherein the projections have an upstream facing ramp forming an angle of substantially 30° with the floor of the profile surface.

3. In a mechanism for screening a stock slurry for making paper, comprising in combination:

a screening housing having an inlet for fibrous stock slurry, an accepts outlet for screened slurry and a rejects outlet;

a screen in the housing positioned for receiving the slurry on a profile surface and having accept flow openings extending through the screen for passing accepts from one side of the screen to another side of the screen to the accepts outlet and for obtaining rejects which do not pass through the openings to flow to the rejects outlet;

and means generating a screening pulse in the slurry along the profile surface in an induced flow direction;

said profile surface having projections with a recessed floor between projections, the improvement comprising;

the accept flow openings being disposed in the recessed floor between projections, the openings being substantially uniformally located between projections and being located more closely to the upstream projection than to the downstream projection relative to said induced flow direction so that a maximum screening occurs with significant turbulence along the profile surface;

wherein the height of the projections are selected with the location of the openings such that the angle of a line drawn from the tip of the upstream projection to the center of the flow opening is at least 45° with the floor.

4. A mechanism for screening a stock slurry for making paper constructed in accordance with claim 3:

wherein the height of the projections are selected with the location of the openings such that the angle of a line drawn from the top of the upstream projection to the center of the flow opening is at least between 50° and 60° with the profile surface.

5. In a mechanism for screening a stock slurry for making paper, comprising in combination:

a screening housing having an inlet for fibrous stock slurry, an accepts outlet for screened slurry and a rejects outlet;

a screen in the housing positioned for receiving the slurry on a profile surface and having accept flow openings extending through the screen for passing accepts from one side of the screen to another side of the screen to the accepts outlet and for obtaining rejects which do not pass through the openings to flow to the rejects outlet;

and means generating a screening pulse in the slurry along the profile surface in an induced flow direction;

said profile surface having projections with a recessed floor between projections, the improvement comprising;

the accept flow openings being disposed in the recessed floor between projections, the openings being substantially uniformally located between projections and being located more closely to the upstream projection than to the downstream projection relative to said induced flow direction so that a maximum screening occurs with significant turbulence along the profile surface;

wherein the projections rise above the floor a minimum of about 0.032".

6. A mechanism for screening a stock slurry for making paper constructed in accordance with claim 5:

wherein the projections rise above the profile surface at least about 0.040".

7. In a mechanism for screening a stock slurry for making paper, comprising in combination:

a screening housing having an inlet for fibrous stock slurry, an accepts outlet for screened slurry and a rejects outlet;

a screen in the housing positioned for receiving the slurry on a profile surface and having accept flow openings extending through the screen for passing accepts from one side of the screen to another side of the screen to the accepts outlet and for obtaining rejects which do not pass through the openings to flow to the rejects outlet;

and means generating a screening pulse in the slurry along the profile surface in an induced flow direction;

said profile surface having projections with a recessed floor between projections, the improvement comprising;

the accept flow openings being disposed in the recessed floor between projections, the openings being substantially uniformally located between projections and being located more closely to the upstream projection than to the downstream projection relative to said induced flow direction so that a maximum screening occurs with significant turbulence along the profile surface;

wherein said accept flow openings have a depth of at least 0.020".

8. In a mechanism for screening a stock slurry for making paper, comprising in combination:

a screening housing having an inlet for fibrous stock slurry, an accepts outlet for screened slurry and a rejects outlet;

a screen in the housing positioned for receiving the slurry on a profile surface and having accept flow openings extending through the screen for passing accepts from one side of the screen to another side of the screen to the accepts outlet and for obtaining rejects which do not pass through the openings to flow to the rejects outlet;

and means generating a screening pulse in the slurry along the profile surface in an induced flow direction;

said profile surface having projections with a recessed floor between projections, the improvement comprising;

the accept flow openings being disposed in the recessed floor between projections, the openings being substantially uniformally located between projections and being located more closely to the upstream projection than to the downstream projection relative to said induced flow direction so that a maximum screening occurs with significant turbulence along the profile surface;

wherein the depth of said accept flow openings is less than about 0.040".

9. In a mechanism for screening a stock slurry for making paper, comprising in combination:

a screening housing having an inlet for fibrous stock slurry, an accepts outlet for screened slurry and a rejects outlet;

a screen in the housing positioned for receiving the slurry on a profile surface and having accept flow openings extending through the screen for passing accepts from one side of the screen to another side of the screen to the accepts outlet and for obtaining rejects which do not pass through the openings to flow to the rejects outlet;

and means generating a screening pulse in the slurry along the profile surface in an induced flow direction;

said profile surface having projections with a recessed floor between projections, the improvement comprising;

the accept flow openings being disposed in the recessed floor between projections, the openings being substantially uniformally located between projections and being located more closely to the upstream projection than to the downstream projection relative to said induced flow direction so that a maximum screening occurs with significant turbulence along the profile surface;

wherein said projections in the induced flow direction are located at a frequency of about 8 per inch.

10. In a mechanism for screening a stock slurry for making paper, comprising in combination:

a screening housing having an inlet for fibrous stock slurry, an accepts outlet for screened slurry and a rejects outlet;

a screen in the housing positioned for receiving the slurry on a profile surface and having accept flow openings extending through the screen for passing accepts from one side of the screen to another side of the screen to the accepts outlet and for obtaining rejects which do not pass through the openings to flow to the rejects outlet;

and means generating a screening pulse in the slurry along the profile surface in an induced flow direction;

said profile surface having projections with a recessed floor between projections, the improvement comprising;

the accept flow openings being disposed in the recessed floor between projections, the openings being substantially uniformally located between projections and being located more closely to the upstream projection than to the downstream projection relative to said induced flow direction so that a maximum screening occurs with significant turbulence along the profile surface;

wherein the projections in the induced flow direction are located at a frequency of about 6 to 7 per inch.

11. A replaceable screen for a screening mechanism to be positioned in a housing having an inlet for receiving a fibrous stock slurry and having an accept outlet and a reject outlet with the screen positioned between said outlets, a rotor within the housing for generating a screening pulse along the surface of the screen in an induced flow direction; the screen comprising:

a rigid screening member having a profile surface facing the reject outlet with projections thereon and recesses between the projections and accept flow openings in the recesses between the projections;

said accept flow openings being substantially uniformly located relative to adjacent projections and being located more closely to the adjacent upstream projection in the direction of induced flow along the screening member than to the adjacent downstream projection;

wherein the projections have a ramp facing in the upstream direction forming an angle of less than 45° with the floor of the profile surface.

12. A replaceable screen for a screening mechanism to be positioned in a housing having an inlet for receiving a fibrous stock slurry and having an accept outlet and a reject outlet with the screen positioned between said outlets, a rotor within the housing for generating a screening pulse along the surface of the screen in an induced flow direction; the screen comprising:

a rigid screening member having a profile surface facing the reject outlet with projections thereon and recesses between the projections and accept flow openings in the recesses between the projections;

said accept flow openings being substantially uniformly located relative to adjacent projections and being located more closely to the adjacent upstream projection in the direction of induced flow along the screening member than to the adjacent downstream projection;

wherein the height of the projections is selected with the location of the openings such that a line drawn from the trailing peak of the upstream projection to the center of the flow openings forms an angle of at least about 45° with said floor of the profile surface.

13. A replaceable screen for a screening mechanism to be positioned in a housing having an inlet for receiving a fibrous stock slurry and having an accept outlet and a reject outlet with the screen positioned between said outlets, a rotor within the housing for generating a screening pulse along the surface of the screen in an induced flow direction; the screen comprising:

a rigid screening member having a profile surface facing the reject outlet with projections thereon and recesses between the projections and accept flow openings in the recesses between the projections;

said accept flow openings being substantially uniformly located relative to adjacent projections and being located more closely to the adjacent upstream projection in the direction of induced flow along the screening member than to the adjacent downstream projection;

wherein said projections have a height above the profile surface more than 0.032".

14. A replaceable screen for a screening mechanism to be positioned in a housing having an inlet for receiving a fibrous stock slurry and having an accept outlet and a reject outlet with the screen positioned between said outlets, a rotor within the housing for generating a screening pulse along the surface of the screen in an induced flow direction; the screen comprising:

a rigid screening member having a profile surface facing the reject outlet with projections thereon and recesses between the projections and accept flow openings in the recesses between the projections;

said accept flow openings being substantially uniformly located relative to adjacent projections and being located more closely to the adjacent upstream projection in the direction of induced flow along the screening member than to the adjacent downstream projection;

wherein the depth of said flow openings is at least 0.020".

15. A replaceable screen for a screening mechanism to be positioned in a housing having an inlet for receiving a fibrous stock slurry and having an accept outlet and a reject outlet with the screen positioned between said outlets, a rotor within the housing for generating a screening pulse along the surface of the screen in an induced flow direction; the screen comprising:

a rigid screening member having a profile surface facing the reject outlet with projections thereon and recesses between the projections and accept flow openings in the recesses between the projections;

said accept flow openings being substantially uniformly located relative to adjacent projections and being located more closely to the adjacent upstream projection in the direction of induced flow along the screening member than to the adjacent downstream projection;

wherein said projections are arranged to be no more than 8 per inch.

* * * * *